US011002080B2

(12) United States Patent
Trunk

(10) Patent No.: US 11,002,080 B2
(45) Date of Patent: May 11, 2021

(54) STAGED UNDERREAMER CUTTER BLOCK

(71) Applicant: Schlumberger Technology Corporation, Sugar Land, TX (US)

(72) Inventor: Philip G. Trunk, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 186 days.

(21) Appl. No.: 16/072,524

(22) PCT Filed: Jan. 19, 2017

(86) PCT No.: PCT/US2017/014005
§ 371 (c)(1),
(2) Date: Jul. 25, 2018

(87) PCT Pub. No.: WO2017/132033
PCT Pub. Date: Aug. 3, 2017

(65) Prior Publication Data

US 2019/0032409 A1 Jan. 31, 2019

Related U.S. Application Data

(60) Provisional application No. 62/288,214, filed on Jan. 28, 2016.

(51) Int. Cl.
*E21B 10/32* (2006.01)
*E21B 10/60* (2006.01)
*E21B 17/10* (2006.01)

(52) U.S. Cl.
CPC ..... *E21B 10/322* (2013.01); *E21B 10/60* (2013.01); *E21B 17/1092* (2013.01)

(58) Field of Classification Search
CPC ..... E21B 10/322; E21B 10/60; E21B 17/1092
See application file for complete search history.

(56) References Cited

U.S. PATENT DOCUMENTS 6,732,817 B2 5/2004 Dewey et al.
7,997,354 B2 8/2011 Radford et al.
(Continued)

FOREIGN PATENT DOCUMENTS

CN 2672275 Y 1/2005
CN 202483447 U 10/2012
(Continued)

OTHER PUBLICATIONS

Office Action received in U.S. Appl. No. 16/072,517 dated Jun. 4, 2020, 8 pages.
(Continued)

*Primary Examiner* — Yong-Suk (Philip) Ro

(57) ABSTRACT

A cutter block includes a formation facing surface having a staged cutting profile and one or more stabilizer pads may be located between reaming portions. A shorter stabilizer pad or no stabilizer pad may be at the gauge of the cutter block. A spline on the cutter block and used by a downhole cutting apparatus to move the cutter block may intersect the formation facing surface. The spline may form an extension that increases a width of the formation facing surface. The extension may be located at a stabilizer pad to expand the stabilizer pad, such that the extension rotationally leads or trails cutting structure of the cutter block. When the cutter block is expanded, a stabilizer pad may be at a pilot diameter of a wellbore, while some cutting elements may be radially outside, and others radially within, the pilot diameter of the wellbore.

11 Claims, 8 Drawing Sheets

(56) References Cited

U.S. PATENT DOCUMENTS

| | | | | |
|---|---|---|---|---|
| 2003/0155155 | A1* | 8/2003 | Dewey | E21B 10/322 175/57 |
| 2006/0207797 | A1 | 9/2006 | Dewey et al. | |
| 2010/0018779 | A1 | 1/2010 | Makkar et al. | |
| 2010/0276201 | A1 | 11/2010 | Makkar et al. | |
| 2012/0012397 | A1 | 1/2012 | Hall et al. | |
| 2012/0073879 | A1 | 3/2012 | Makkar et al. | |
| 2013/0146361 | A1 | 6/2013 | Makkar et al. | |
| 2013/0256036 | A1 | 10/2013 | Lyons | |
| 2014/0262523 | A1 | 9/2014 | Davis | |
| 2015/0068813 | A1 | 3/2015 | Moreno et al. | |
| 2015/0144405 | A1* | 5/2015 | Salvo | E21B 10/322 175/263 |
| 2015/0184463 | A1 | 7/2015 | Patel et al. | |
| 2015/0285004 | A1 | 10/2015 | Makkar et al. | |

FOREIGN PATENT DOCUMENTS

| | | | |
|---|---|---|---|
| CN | 202832221 | U | 3/2013 |
| CN | 103485723 | A | 1/2014 |
| CN | 203701981 | U | 7/2014 |
| CN | 104499944 | A | 4/2015 |
| GB | 2460096 | A | 11/2009 |
| WO | WO2015167788 | A1 | 11/2015 |
| WO | WO2017132052 | A1 | 8/2017 |

OTHER PUBLICATIONS

International Search Report and Written Opinion issued in International Patent Application No. PCT/US2017/014206 dated Apr. 27, 2017, 12 pages.

International Search Report and Written Opinion issued in International Patent Application No. PCT/US2017/014005 dated Apr. 27, 2017, 12 pages.

First Office Action issued in Chinese Patent Application No. 201780008910.6 dated Nov. 14, 2019, 13 pages with English Translation.

First Office Action issued in Chinese Patent Application No. 201780008757.7 dated Oct. 23, 2019, 15 pages with English Translation.

International Preliminary Report on Patentability issued in International Patent Application No. PCT/US2017/014206 dated Jul. 31, 2018, 8 pages.

International Preliminary Report on Patentability issued in International Patent Application No. PCT/US2017/014005 dated Jul. 31, 2018, 10 pages.

Second Office Action issued in Chinese Patent Application No. 201780008910.6 dated Oct. 26, 2020, 9 pages with English Translation.

* cited by examiner

STAGED UNDERREAMER CUTTER BLOCK

CROSS-REFERENCE TO RELATED APPLICATIONS

This application is a U.S. national phase of International Patent Application No. PCT/US2017/014005, filed Jan. 19, 2017, and entitled "Staged Underreamer Cutter Block," which claims the benefit of, and priority to, U.S. Patent Application No. 62/288,214, filed Jan. 28, 2016, which applications are expressly incorporated herein by this reference in their entireties.

BACKGROUND

In the drilling of oil and gas wells, concentric casing strings are installed and cemented in the wellbore as drilling progresses to increasing depths. Each new casing string may run from the surface or may include a liner suspended from a previously installed casing string. The new casing string may be within the previously installed casing string, thereby limiting the annular area available for the cementing operation. Further, as successively smaller diameter casing strings are used, the flow area for the production of oil and gas is reduced. To increase the annular space for the cementing operation, and to increase the production flow area, it may be desirable to enlarge the wellbore below the terminal end of the previously cased portion of the wellbore. By enlarging the wellbore, a larger annular area is provided for subsequently installing and cementing a larger casing string than would have been possible otherwise. Accordingly, by enlarging the wellbore below the previously cased portion of the wellbore, comparatively larger diameter casing may be used at increased depths, thereby providing more flow area for the production of oil and gas.

Various methods have been devised for passing a drilling assembly through an existing cased portion of a wellbore and enlarging the wellbore below the casing. One such method is the use of an underreamer, which has two basic operative states. A first state is a closed, retracted, or collapsed state, where the diameter of the tool is sufficiently small to allow the tool to pass through the existing cased portion of the wellbore. The second state is an open, active, or expanded state, where arms or cutter blocks extend from the body of the tool. In this second state, the underreamer enlarges the wellbore diameter as the tool is rotated and lowered and moved axially in the wellbore.

SUMMARY

According to some embodiments of the present disclosure, a cutting apparatus includes a cutter arm having first and second stabilizer portions adjacent reaming portions of the cutter arm. The first stabilizer portion is adjacent a first reaming portion and the second stabilizer portion is between first and second reaming portions. A gauge portion of the cutter arm is positioned adjacent the second reaming portions and either has no stabilizer portion or has a third stabilizer portion that is shorter than the first stabilizer portion, the second stabilizer portion, or both. Cutting elements are located in the first and second reaming portions of the cutter arm.

According to additional embodiments of the present disclosure, a downhole assembly may include a bit and a cutting tool uphole of the bit. The cutting tool may have expandable cutter arms. An expandable cutter arm can include a stabilizer portion with a radial position that is about the same as the gauge of the bit when the expandable cutter arm is in an expanded position.

In additional embodiments, a cutter arm for a downhole tool includes a body defining a formation facing surface, a leading side surface, and a trailing side surface. Cutting elements are coupled to the formation facing surface. A spline on the leading side surface or a spline on the trailing side surface intersects the formation facing surface and forms a lateral extension of the formation facing surface.

In another example embodiment, a method for expanding a diameter of a wellbore includes tripping an underreamer into a wellbore while the underreamer is in a retracted position. Cutter blocks are expanded to transition the underreamer into an expanded position, and expanding the cutter blocks includes expanding a cutter blocks that include one or more features. Example features include a spline extension at a stabilizer pad, the spline extension rotationally leading or trailing a cutting structure of a cutter block; a stabilizer pad that, when the cutter block is expanded, has a radial position about equal to a pilot size of the wellbore; cutting structure that, when the cutter block is expanded, has a radial position less than the pilot size of the wellbore; or multiple stages of reaming portions separated by stabilizer pads, a gauge of the a cutter block including no stabilizer pad or a stabilizer pad having a length less than the length of another stabilizer pad. The formation is also degraded around the wellbore by moving the underreamer axially and rotationally within the wellbore.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF DRAWINGS

FIGS. 2-1 and 2-2 are partial cut-away views of an underreamer, in accordance with embodiments disclosed herein.

FIG. 3-1 is a perspective view of a cutter block for an underreamer, in accordance with embodiments disclosed herein.

FIG. 3-2 is a side view of the cutter block of FIG. 3-1.

FIG. 3-3 is a top view of the cutter block of FIG. 3-1.

FIGS. 9-1 is a perspective view of a ridge cutting element, in accordance with embodiments disclosed herein.

FIG. 9-2 is a side view of the ridge cutting element of FIG. 9-1.

FIGS. 11-1 to 11-3 are side views of cutting elements at varying back rake angles, in accordance with embodiments disclosed herein.

FIGS. 13-1 to 14-3 are various views of cutting elements having varying side rake angles, in accordance with embodiments disclosed herein.

DETAILED DESCRIPTION

In some aspects, embodiments disclosed herein relate generally to cutting structures for use on drilling tool assemblies. More specifically, some embodiments disclosed herein relate to cutting structures for an underreamer or other tool used to enlarge a wellbore.

According to some aspects of the disclosure, there is provided a downhole cutting apparatus, such as an underreamer, which may include a cutter block. The cutter block may have an underreaming portion or edge, a backreaming portion or edge, or both. In one or more embodiments, the downhole cutting apparatus may be an expandable tool and the cutter block may be radially movable between any combination of a retracted position, partially expanded positions, and a fully expanded position. In one or more other embodiments, the downhole cutting apparatus may be a downhole cutting tool that is not expandable. For example, in one or more embodiments, the downhole cutting apparatus may be a hole opener having a fixed cutter block.

Figure 1:
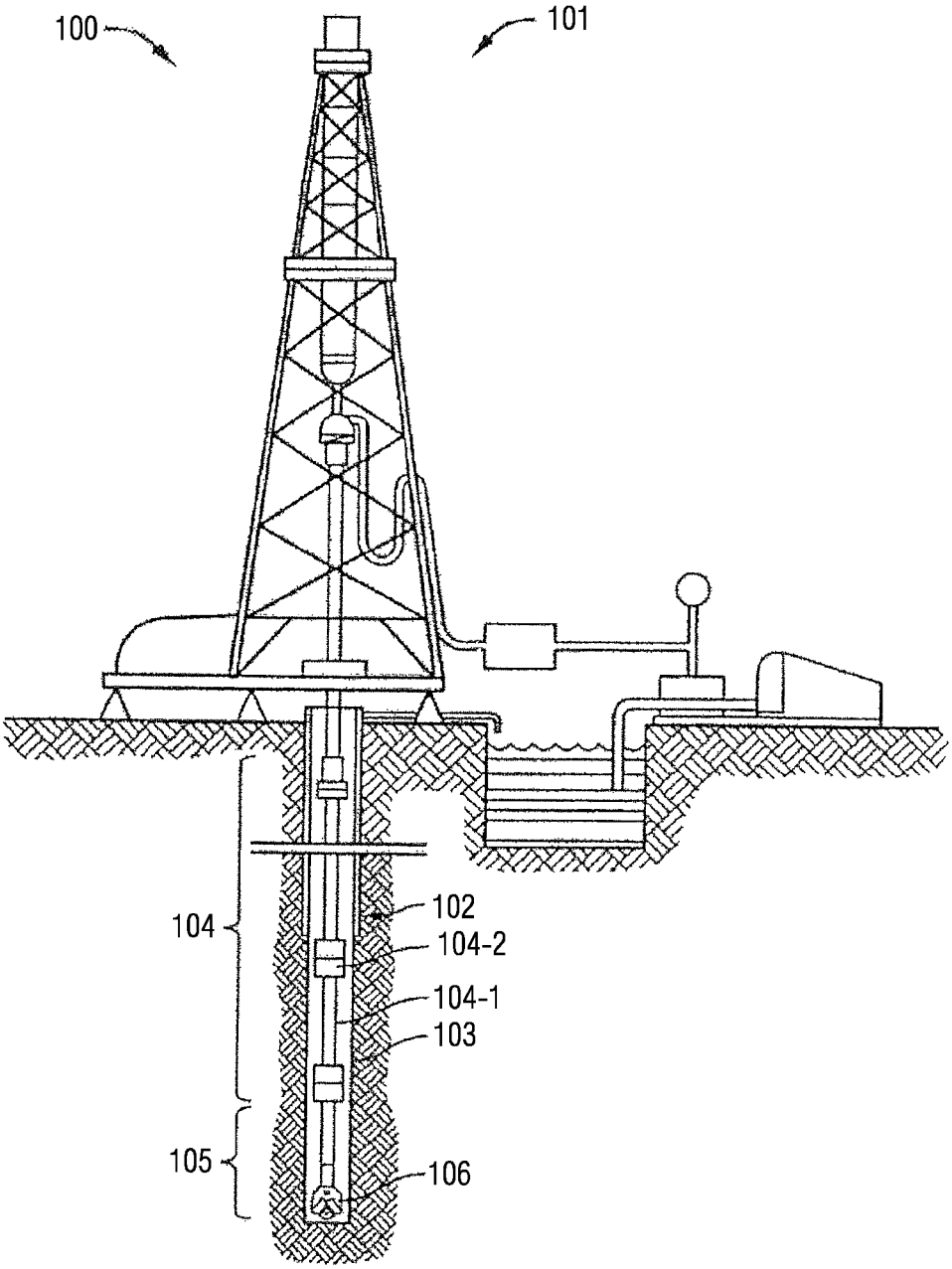
FIG. 1 is a schematic representation of a drilling operation.

Referring now to FIG. 1, one example of a system for drilling an earth formation is shown. The drilling system 100 includes a drilling rig 101 used to turn a drilling tool assembly 102 that extends into a wellbore 103. The drilling tool assembly 102 includes a drill string 104 and a bottomhole assembly ("BHA") 105 attached to a distal or downhole end portion of the drill string 104. The distal end portion of the drill string 104 is the portion farthest from the drilling rig 101.

The drill string 104 includes several joints of drill pipe 104-1 connected end-to-end through tool joints 104-2. The drill string 104 may be used to insert or trip the BHA 105 into the wellbore 103. The drill string 104 may transmit drilling fluid (e.g., through a bore extending through hollow tubular members), transmit rotational power from the drilling rig 101 to the BHA 105, transmit weight to the BHA 105 (e.g., using weight of the drill string 104), move the BHA 105 axially within the wellbore, or combinations of the foregoing. In some embodiments, one or more of the drill string 104 or the BHA 105 further includes additional components such as subs, pup joints, valves, actuation assemblies, etc.

The BHA 105 in FIG. 1 includes a drill bit 106. A BHA 105 may also include additional components attached between the drill string 104 and the drill bit 106. Examples of additional BHA components include drill collars, stabilizers, measurement-while-drilling (MWD) tools, logging-while-drilling (LWD) tools, subs, hole enlargement devices (e.g., hole openers and reamers), jars, thrusters, downhole motors, sensors, and rotary steerable systems.

Figures 1, 2:
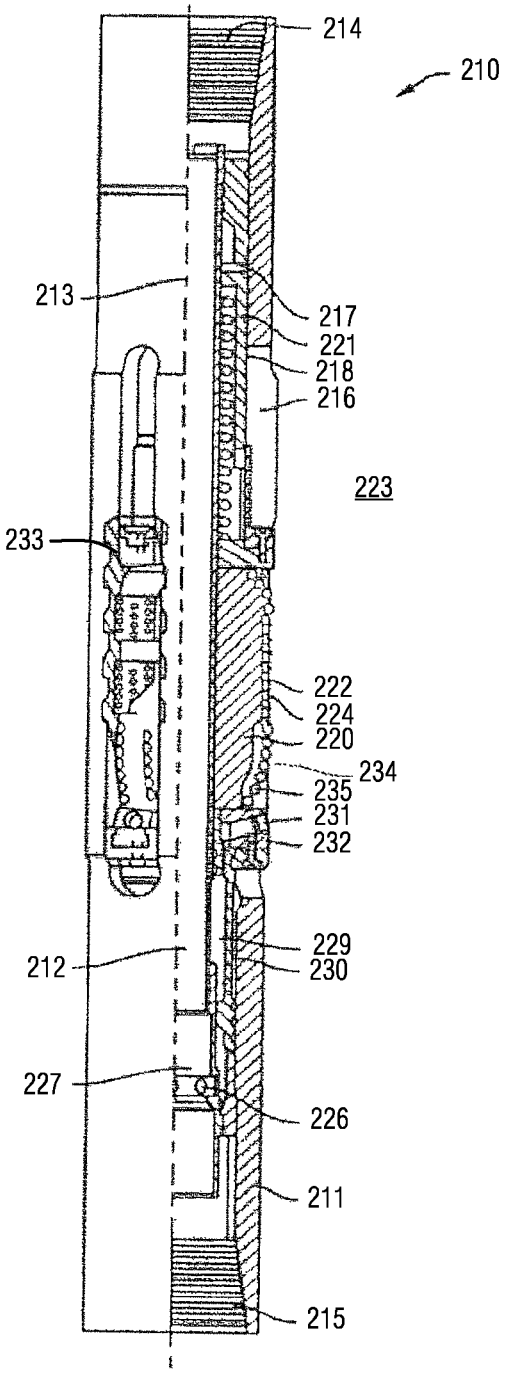
Figure 2:
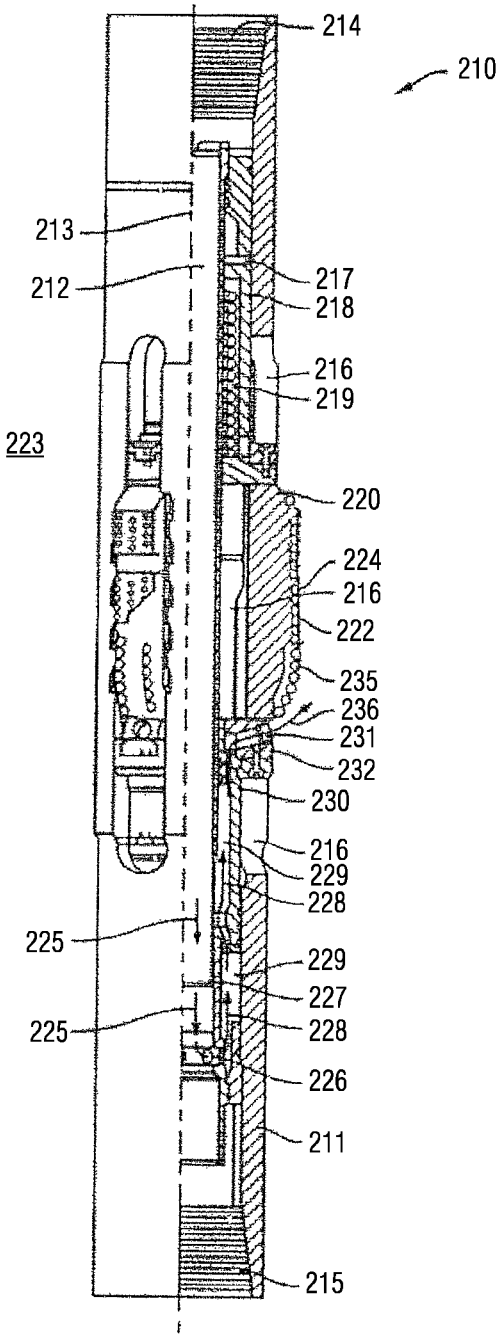

Referring to FIGS. 2-1 and 2-2, an expandable tool, which may be used in embodiments of the present disclosure, generally designated as underreamer 210, is shown in a collapsed position in FIG. 2-1 and in an expanded position in FIG. 2-2. The underreamer 210 may include a generally cylindrical tubular tool body 211 with a flowbore 212 extending fully or partially therethrough along a longitudinal axis 213 of the underreamer 210. As shown, the tool body 211 may include an upper connection portion 214 and a lower connection portion 215 for coupling the underreamer 210 to a drill string, BHA, or other downhole assembly. Further, as shown, one or more recesses 216 may be formed in the tool body 211, and optionally at approximately the axial center of the tool body 211. The one or more recesses 216 may be spaced apart azimuthally around the circumference of the tool body 211, and may be axially aligned or misaligned in various embodiments. The one or more recesses 216 may accommodate the axial movement of one or more components of the underreamer 210 that move axially within the tool body 211, and potentially within the recesses 216, including one or more moveable tool arms, such as cutter blocks 220. The cutter blocks 220 may be non-pivotable in some embodiments, but movable tool arms or cuter blocks may pivot in other embodiments. Each recess 216 may fully or partially store one or more cutter blocks 220 in the collapsed or retracted position.

FIG. 2-2 shows the underreamer 210 with the cutter blocks 220 in an expanded position (e.g., a maximum or fully expanded position), extending radially outwardly from the tool body 211. Once the underreamer 210 is in the wellbore, one or more of the cutter blocks 220 may be expandable to one or more radial positions. The underreamer 210 may therefore have at least two operational positions-including at least a collapsed or retracted position as shown in FIG. 2-1 and an expanded position as shown in FIG. 2-2. In other embodiments, the underreamer 210 may have multiple operational positions where the cutter blocks 220 are between fully retracted and fully expanded states (e.g., in partially expanded states). In some embodiments, a spring retainer 218, which may include a threaded sleeve, may be adjusted at the surface or using a downhole drive system, to limit the full diameter expansion of the cutter blocks 220. The spring retainer 218 may compress a biasing spring 219 when the underreamer 210 is collapsed, and the position of the spring retainer 218 may determine the amount of expansion of the cutter blocks 220. The spring retainer 218 may be adjusted by a wrench (not shown) in a wrench slot 217 that may rotate the spring retainer 218 axially downwardly or upwardly with respect to the tool body 211 at threads 221.

In the expanded position shown in FIG. 2-2, the cutter blocks 220 may be used to underream the wellbore, backream the wellbore, stabilizing a downhole or drilling assembly within the wellbore, or combinations of the foregoing. The operations performed may depend on the configuration of the cutter blocks 220, including one or more pads 222 and other surfaces. In some embodiments, the cutter blocks 220 may have configurations as further discussed herein. Hydraulic force within the underreamer 210 may cause the cutter blocks 220 to expand radially outwardly (and optionally to move axially upwardly) to the position shown in FIG. 2-2 due to the differential pressure of the drilling fluid between the flowbore 212 and the wellbore annulus 223.

In one or more embodiments, optional depth of cut limiters 224 on pad 222 may be formed from polycrystalline diamond, tungsten carbide, titanium carbide, cubic boron nitride, other superhard materials, or some combination of the foregoing. Depth of cut limiters 224 may include inserts with cutting capacity, such as back-up cutting elements or cutters, diamond impregnated inserts with less exposure than primary cutting elements, diamond enhanced inserts, tungsten carbide inserts, semi-round top inserts, or other inserts that may or may not have a designated cutting capacity. Optionally, the depth of cut limiters 224 may not primarily engage formation during reaming; however, after wear of primary cutting elements, depth of cut limiters 224 may engage the formation to protect the primary cutting elements from increased loads as a result of worn primary cutting elements. In one or more embodiments, depth of cut limiters 224 may be positioned above or uphole from primary cutting elements on a shoulder of the cutter block 220. The axial and/or radial distance from the primary cutting elements may be selected such that depth of cut limiters 224 may remain largely unengaged with formation until wear of other cutting elements occurs, or the depth of cut limiters 224 may engage the formation initially, before wear of the cutting elements. Depth of cut limiters 224 may aid in maintaining a desired wellbore gauge by providing increased structural integrity to the cutter block 220.

Drilling fluid may flow along path 225, through ports 226 in a lower retainer 227, along path 228 into a piston chamber 229. A differential pressure between fluid in the flowbore 212 and the fluid in the wellbore annulus 223 surrounding the underreamer 210 may cause the piston 230 to move axially upwardly from the position shown in FIG. 2-1 to the position shown in FIG. 2-2. A small amount of fluid can flow through the piston chamber 229 and through nozzles 231 to the wellbore annulus 223 as the cutter blocks 220 of the underreamer 210 expand. As the piston 230 moves axially upwardly in recesses 216, the piston 230 engages a drive ring 232, thereby causing the drive ring 232 to move axially upwardly against the cutter blocks 220. The drive ring 232 will move the cutter blocks 220 axially upwardly in recesses 216 and radially outwardly as the cutter blocks 220 travel in or along channels or splines 233 in or on the tool body 211. In the expanded position, the flow continues along paths 225, 228 and out into the wellbore annulus 223 through nozzles 231. The nozzles 231 may be part of the drive ring 232, and may therefore move axially with the cutter blocks 220. Accordingly, these nozzles 231 may be positioned to provide continuous cleaning and cooling to cutting elements 235 on surface(s) 234 as fluid exits to the wellbore annulus 223 along flow path 236. In other embodiments, the nozzles 231 may be omitted or may not travel with the cutter blocks 220.

The underreamer 210 may be designed to remain generally concentric within a wellbore. In particular, the underreamer 210, in some embodiments, may include three extendable cutter blocks 220 spaced apart circumferentially at the same axial location on the tool body 211. In some embodiments, the circumferential spacing may be approximately 120°. A three-block design may provide a full gauge underreamer 210 that remains centralized in the wellbore. Embodiments disclosed herein are not limited to tool embodiments having three extendable cutter blocks 220. For example, in one or more embodiments, the underreamer 210 may include different configurations of spaced cutter blocks (e.g., spaced axially, circumferentially, or both), or other types of arms, for example, one arm, two arms, four arms, five arms, or more than five arm designs. Thus, in some embodiments, the circumferential spacing of the cutter blocks or other arms may vary from the 120° spacing described herein. For example, in other embodiments, the circumferential spacing may be 90°, 60°, or the cutter blocks 220 may be circumferentially spaced in unequal increments. Further, in some embodiments, one or more of the cutter blocks 220 may be axially offset from one or more other cutter blocks 220. Accordingly, the cutting structure designs disclosed herein may be used with any number of cutting structures and tools.

Figures 1, 3:
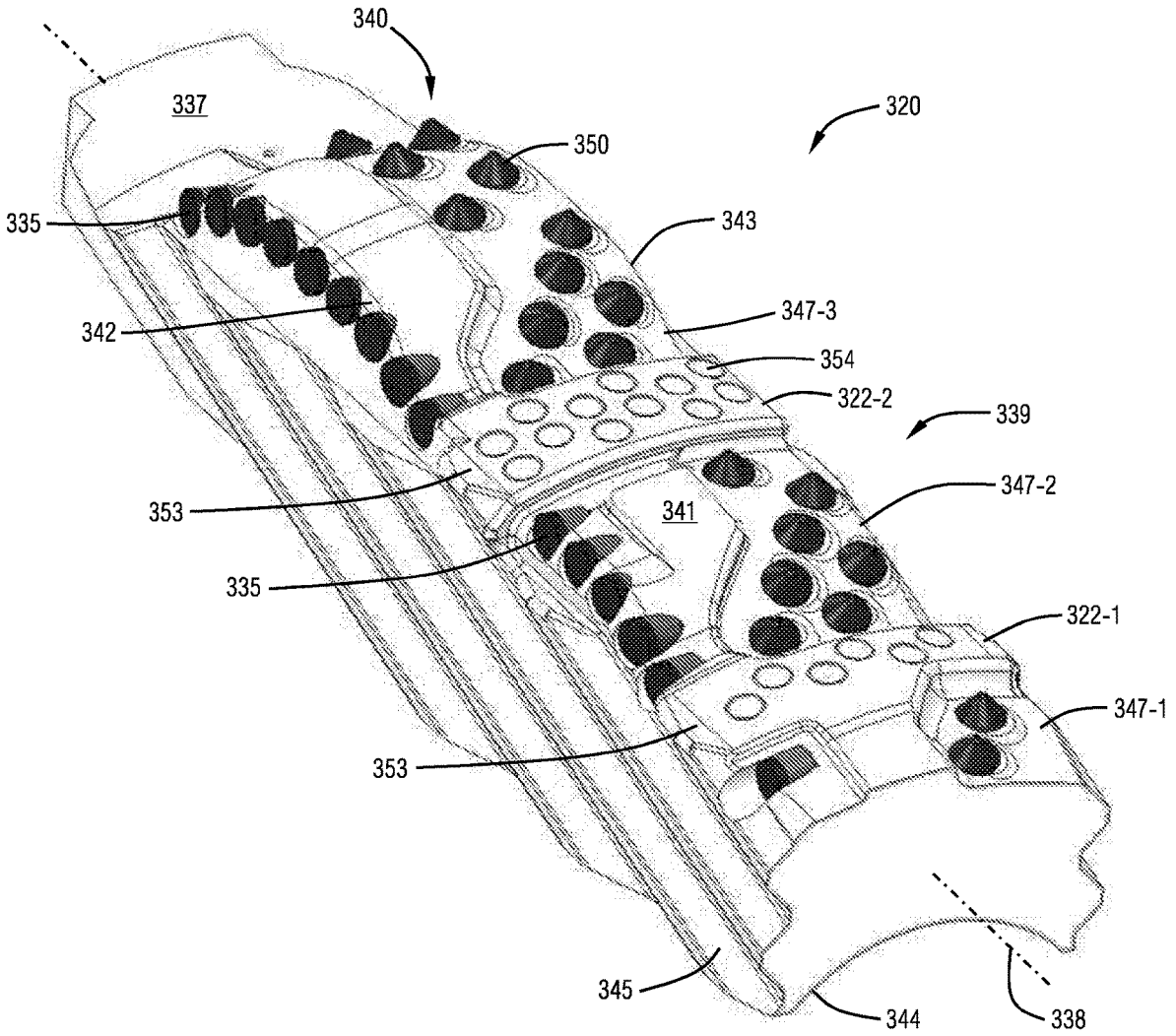
Figures 2, 3:
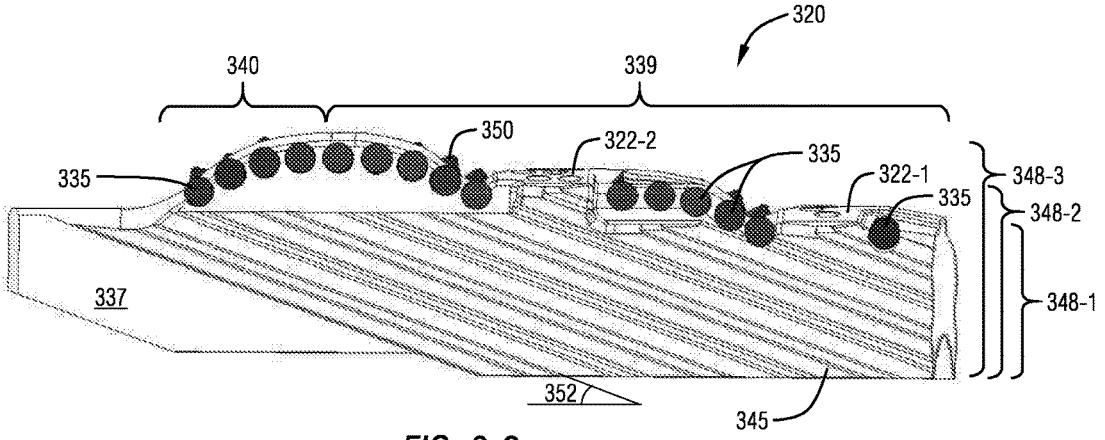
Figure 3:
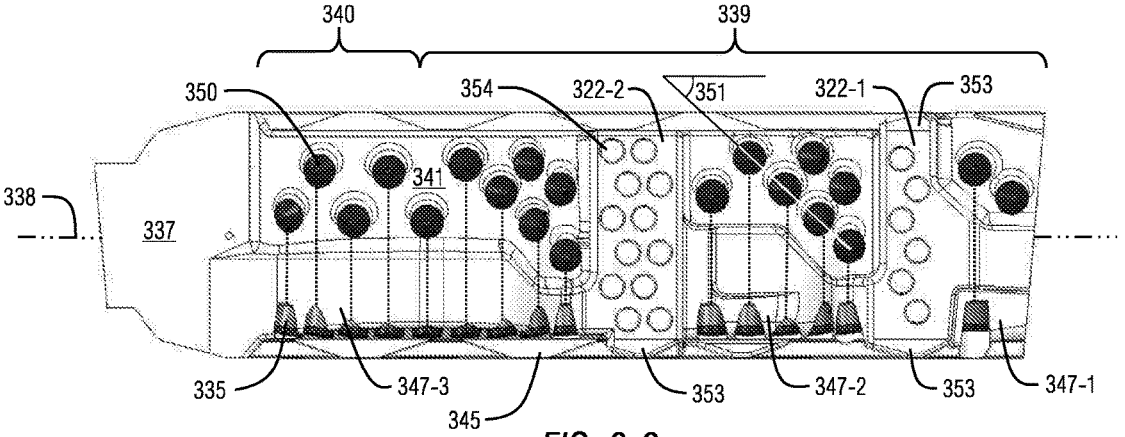

FIGS. 3-1 to 3-3 illustrate various views of a cutter bock 320 in accordance with embodiments described herein. As shown, the cutter block 320 may include a body 337 having a longitudinal axis 338. The cutter block 320 may further include a downhole end portion 339 and an uphole end portion 340. In some embodiments, the downhole end portion 339 may be used for a downreaming or underreaming operation and the uphole end portion 340 may be used for an upreaming or backreaming operation.

The body 337 of the cutter block 320 may further include or define a formation facing surface 341 arranged to abut, engage, or be positioned against or toward the formation within a wellbore. The cutter block 320 may be rotated in the wellbore, and the body 337 may define a leading side surface 342 facing the direction of rotation, and a trailing side surface 343 facing away from the direction of rotation. The formation facing surface 341 may generally extend laterally between the leading and trailing side surfaces 342, 343 and longitudinally in the direction of the longitudinal axis 338. A bottom surface 344 may also extend laterally between the leading and trailing side surfaces 342, 343 and longitudinally in the direction of the longitudinal axis 338, but may face away from the formation. Optionally, the bottom face 344 may be planar. In other embodiments, the bottom face 344 may be curved, have an arc, have some contour, or some combination of the foregoing.

In some embodiments, one or more splines or channels (collectively designated splines 345) may be formed on the leading side surface 342, the trailing side surface 343, or both, and used in selectively expanding or retracting the cutter block 320. For instance, the splines 345 may engage corresponding splines of a reamer body (e.g., splines 233 in FIG. 2-1), which may direct the cutter block 320 as it moves axially/longitudinally between radially expanded and radially retracted positions.

In one or more embodiments, the body 337 may be formed from a metal material, a matrix material, other materials, or a combination of the foregoing. For instance, the body 337 may be formed of or include steel, tungsten carbide, titanium carbide, or any other material known in the art. The cutter block 320 may be configured to be coupled to a downhole tool (e.g., the underreamer 230 shown in FIGS. 2-1 and 2-2). In one or more embodiments, the downhole end portion 339 of the cutter block 320 may be farther downhole than the uphole end portion 340 of the cutter block 320 (or farther from the surface of the wellbore) when the cutter block 320 is coupled to the downhole tool and within a wellbore. In one or more embodiments, the cutter block 320 may have a plurality of cutting elements 335 on, in, or otherwise coupled to the formation facing surface 341 of the body 337. In some embodiments, one or more cutting elements 335 may be on, in, or otherwise coupled to a leading edge 346 of the leading side surface 342 of the body 337. In one or more embodiments, the cutting elements 335 may be formed from tungsten carbide, polycrystalline diamond, cubic boron nitride, other materials, or any combination of the foregoing. In some embodiments, cutting elements, gauge protection elements, depth of cut limiters, or other components may be welded, brazed, bonded, adhered, press fit, or otherwise coupled to the body 337 (e.g., brazed within respective pockets formed in the body 337). In further examples, cutting elements, gauge protection elements, depth of cut limiters, or other components may be coupled to the body 337 by being integrally formed therewith, through infiltration techniques, or in other manners.

As shown, the cutting elements 335 coupled to the body 337 (e.g., within the downhole portion 339, the uphole portion 340, or both) may be arranged in one or more rows. In the example illustrated embodiment, for instance, a single row of cutting elements 335 is shown as extending along the leading face 342 in both the downhole portion 339 and the uphole portion 340 of the cutter block 320. In some embodiments, the row may be continuous along a full length of the row, along the downhole portion 339, along the uphole portion 340, or any combination of the forgoing. In FIGS. 3-1 to 3-3, for instance, the row of cutting elements 335 is continuous along a length of the uphole portion 340. The row may, however, be interrupted along the downhole portion 339 of the cutter block 320. In particular, the illustrated embodiment illustrates multiple underreaming portions 347-1, 347-2, 347-3 (collectively underreaming portions 347) and one or more stabilizer pads 322-1, 322-2 (collectively stabilizer pads 322). Specifically, stabilizer pad 322-1 is, in this example embodiment, positioned between underreaming portions 347-1 and 347-2 while stabilizer pad 322-2 is between underreaming portions 347-2 and 347-3.

In some embodiments, and as clearly shown in FIG. 3-2, the stabilizer pads 322-1, 322-2 may be at different radial positions, have the same or different widths (e.g., laterally between leading and trailing side surfaces 342, 343), different the same or different axial lengths, or combinations of the foregoing. The underreaming portions 347 may be angled or contoured to have variable radial positions to transition to, from, or between different stabilizer pads 322, a gauge radius of the cutter block 320, an uphole or downhole end surface of the cutter block 320, or combinations of the foregoing. The result may be a staged cutting structure in which one or more stabilizer pads 322 interrupt a continuous or otherwise curved/contoured profile. For instance, the height 348-1 of the cutter block 320 at the first stabilizer pad 322-1 may be less than the height 348-2 of the cutter block 320 at the second stabilizer pad 322-2, which may be less than the full or gauge height 348-3 of the cutter block 320. In some embodiments, the height of the cutter block 320 increases from a downhole end of the cutter block 320 to the first height 348-1 (e.g., through the first underreaming portion 347-1). The height of the cutter block 320 may increase again from the first stabilizer pad 322-1 to the second stabilizer pad 322-2 (e.g., through the second underreaming portion 347-2). Still another increase in the height of the cutter block 320 may occur from the second stabilizer pad 322-2 to the uphole end of the downhole end portion 339 (e.g., through the third underreaming portion 347-3, and right-to-left in FIG. 3-2). The height of the cutter block 320 may then decrease through the uphole end portion 340 from the downhole end of the uphole end portion 340 toward the uphole end of the uphole end portion 340 (e.g., right-to-left in FIG. 3-2).

Optionally, one or more additional or other stabilizer pads may be included on the cutter block 320. For instance, an additional stabilizer pad may be located downhole of the first underreamer portion 347-1. In some embodiments, such a stabilizer pad may have a relatively constant radial position similar to stabilizer pads 322-1, 322-2, although in other embodiments the stabilizer pad downhole of the first reaming portion 347-1 may be inclined (e.g., angled inwardly and downwardly). In some embodiments, a stabilizer pad may be located at a gauge portion of the cutter block 320 (e.g., at a transition between the downhole end portion 339 and the uphole end portion 340). In at least some embodiments, the length of a stabilizer pad at a gauge portion of the cutter block 320 may be less than the length of the stabilizer pad 322-1, the stabilizer pad 322-2, other stabilizer pads on the cutter block 320, or any combination of the foregoing. In still other embodiments, the length of a stabilizer pad in the gauge portion of the cutter block 320 may be the same length as, or longer than, the length of the stabilizer pad 322-1, the stabilizer pad 322-2, other stabilizer pads on the cutter block 320, or any combination of the foregoing. In still other embodiments, additional or other stabilizer pads may be located within the uphole end portion 340, in other locations, or at other locations.

In accordance with some embodiments of the present disclosure, the cutter block 320 may be used in an expandable tool such as an underreamer or other downhole tool. In at least one embodiment, the expandable tool may be tripped into a wellbore while the cutter block 320 (or multiple cutter blocks 320) are in a retracted state. In the retracted state, the formation facing surface 341 of the cutter block 320 may be radially within a body of the expandable tool, or slightly radially outward of the body of the expandable tool. For instance, the radially position of the facing surface 341 may be less than or about equal to the pilot diameter of the wellbore (e.g., the pilot diameter of a bit used to form the wellbore). Upon reaching a desired location within the wellbore, the expandable tool may be activated and the cutter block 320 may be fully or partially expanded and the downhole tool may be rotated to cut or otherwise degrade the formation or other workpiece around the wellbore. In at least some embodiments, the cutter block 320 may have a staged construction. In the expanded state, the formation facing surface 341 may be expanded beyond the pilot diameter of the wellbore.

According to some embodiments, at least a portion of the formation facing surface 341 may be within or about equal to the pilot diameter of the wellbore. For instance, when the cutter block 320 is expanded, the underreaming portion 347-1 may be configured to remain within the pilot diameter of the wellbore. Cutting elements 335, 350 on the underreaming portion 347-1 may therefore not be arranged, designed, or otherwise configured for use in expanding the wellbore beyond the pilot diameter. Rather, such cutting elements 335, 350 may be used to clean irregularities within the pilot wellbore (e.g., as a result of swelling or shifting). Such an operation may reduce erratic loading on leading cutting elements 335, increase wellbore quality and consistency, improve stability of the expandable tool, contribute to other factors, or any combination of the foregoing. In some embodiments, the first stabilizer pad 322-1 may be configured to be at the pilot diameter of the wellbore when the cutter block 320 is expanded (e.g., fully expanded). Thus, in a BHA that includes a drill bit and an expandable tool, the stabilizer pad 322-1 (or optionally another stabilizer pad) may have about the same radial position as the gauge of the drill bit.

The cutting elements 335 are shown as optionally being oriented along the leading side surface 342 of the cutter block 320, and about parallel to the longitudinal axis 338; however, in other embodiments, the cutting elements 335 may be otherwise configured. For instance, the cutting elements 335 may in whole or in part be oriented in angled rows across a width of the cutter block 320, in a helical pattern, in other manners, or in a combination of the foregoing. In some embodiments, cutting elements 335 may be leading cutting elements, and additional cutting elements 335 may be trailing cutting elements 335 located laterally in one or more rows or positions nearer the trailing side surface 343. Trailing cutting elements 335 may be of the same type as the cutting elements 335 (e.g., shear or planar cutting elements), or they may be different.

In FIGS. 3-1 to 3-3, for instance, cutting elements 350 of a different type may be positioned rotationally behind leading cutting elements 335 and used as trailing or back-up cutting elements. In the illustrated embodiment, the cutting elements 350 are shown as conical cutting elements that rotationally trail the cutting elements 335. Of course, in other embodiments, the cutting elements 350 may be other non-planar cutting elements, or may even be planar cutting elements as discussed herein.

As shown by the dotted lines in FIG. 3-3, at least some of the trailing cutting elements 350 may be positioned at the same axial position as a leading cutting element 335, to thereby act as a back-up cutting element. For instance, each leading cutting element 335 optionally includes a corresponding back-up, trailing cutting element 350. In other embodiments, however, all, some, or none of the leading cutting elements 335 may have a corresponding back-up cutting element 350. For instance, trailing cutting elements 350 may be axially offset from leading cutting elements 335 (e.g., within gaps between cutting elements 335). In still other embodiments, the cutter block may include some trailing cutting elements 350 that back-up leading cutting elements 335 and other trailing cutting elements 350 that are axially offset from any leading cutting element 335.

The trailing cutting elements 350 may be arranged in any suitable manner on the cutter block 320, and in some embodiments are positioned in one or more rows in the formation facing surface 341 of the cutter block 320. Any rows of trailing cutting elements 350 may be about parallel to rows of leading cutting elements 335, although in other embodiments, rows of trailing cutting elements 350 may not be parallel to the leading cutting elements 335. For instance, one or more of the trailing cutting elements in FIGS. 3-1 to 3-3 may be oriented at an angle 351 relative to the longitudinal axis 338 of the cutter block, relative to a row of leading cutting elements 335, or both. In some embodiments, the angle 351 may be within a range having a lower limit, an upper limit, or both a lower limit and an upper limit that includes any of 5°, 10°, 20°, 30°, 40°, 45°, 50°, 60°, 75°, 90°, or angles therebetween. For example, the angle 351 may be between 25° and 65° or between 40° and 50°. In other embodiments, the angle 351 may be less than 5°. Further, while FIG. 3-3 shows rows of trailing cutting elements 350 that approach the trailing side surface 343 as the row extends in an uphole direction (i.e., up and to the left in the orientation shown in FIG. 3-3), rows of trailing cutting elements 350 may extend at angles in other directions as well (e.g., toward the trailing side surface 343 as the row extends in a downhole direction). In still other embodiments, cutting elements 350 may not be arranged in rows.

The formation facing surface 341 of the cutter block 320 may have a constant or variable width (i.e., distance between leading and trailing side surfaces 341, 342). In other embodiments, such as that shown in FIGS. 3-1 to 3-3, the width of the formation facing surface 341 (and thus the cutter block 320) may vary. For instance, as discussed herein, the cutter block 320 may include one or more splines 345 used in extending and retracting the cutter block 320 within a tool. The splines 345 may extend at an angle 352 relative to a longitudinal axis 338 of the cutter block 320. In some embodiments, the angle 352 may have a lower limit, an upper limit, or a lower limit and an upper limit including any of 5°, 15°, 20°, 25°, 30°, 35°, 45°, 55°, 65°, 75°, 90°, or angles therebetween. For instance, the angle 352 may be between 10° and 45° or between 20° and 30°. In other embodiments, the angle 352 may be less than 5°.

The splines 345 may extend a full or partial height of the cutter block. In at least some embodiments, a spline 345 may terminate adjacent a stabilizer pad 322. When such a spline 345 also extends to or near the radial position of a stabilizer pad 322, the spline 322 may intersect the formation facing surface 341. In such embodiments, the splines 345 may form an extension 353 on the stabilizer pad 322. The extensions 353 may extend laterally and may rotationally lead the cutting elements 335, 350 when at or near the leading side surface 342, or may rotationally follow the cutting elements 335, 350 when at or near the trailing side surface 343. An extension 353 to the stabilizer pad 322 that leads cutting elements 335 can, in some embodiments, reduce an amount by which the cutting elements 335 dig into the side of a wellbore wall, thereby acting as a horizontal depth of cut limiter and improving stability. In the same or other embodiments, the extensions 353 can increase a percentage of a wellbore wall that is in contact with the cutter block 320, without a corresponding change to a nominal width of the cutter block 320 (and without a change to openings for mating splines in a tool body), which can further increase stability of a tool.

Stabilizer pads 322 of the present disclosure optionally include one or more gauge protection elements 354. The gauge protection elements 354 may be arranged, designed, or otherwise configured to restrict or even prevent wear of the body 337 and the formation facing surface 341 on the stabilizer pad 322. For instance, as the cutter block 320 is used to cut or degrade formation in a wellbore, the formation may contact the gauge protection elements 354. The gauge protection elements 354 may be formed from polycrystalline diamond, tungsten carbide, titanium carbide, cubic boron nitride, other superhard materials, or some combination of the foregoing. In some embodiments, the gauge protection elements 354 have higher wear resistance properties than the materials of the body 337 (e.g., steel). The gauge protection elements 354 may include diamond enhanced inserts, diamond impregnated inserts, tungsten carbide inserts, semi-round top inserts, inserts with cutting capacity, other inserts or elements, hardfacing, or combinations of the foregoing. For instance, the gauge protection elements 354 may include tungsten carbide inserts.

The gauge protection elements 354 may be arranged in any suitable arrangement or pattern. In FIG. 3-3, for instance, the gauge protection elements 354 are arranged in undulating, axially offset rows. The rows may have the same or different lengths, the same or different numbers of gauge protection elements, equal or unequal spacing between gauge protection elements 354, no axial overlap or greater axial overlap between rows, or combinations of the foregoing. In some embodiments, the gauge protection elements 354 may be replaced with other wear-resistant elements (e.g., hardfacing), aligned in other patterns, or have any other suitable feature.

Cutter blocks, arms, or other elements of a tool may be arranged, designed, or otherwise configured in any number of manners. For instance, the types of cutting elements, arrangements of cutting elements, materials for cutting elements, and the like may be changed from one design to another, varied within a single design or tool, or otherwise varied. In some embodiments, one or more cutter blocks, arms, or other elements may be different from one or more other cutter blocks, arms, or other elements (or each may be different). For instance, each cutter block 320 for a downhole tool may have a different arrangement of: cutting elements 335, 350 (e.g., different positions or numbers of cutting elements to allow multiple cutter blocks to form, in aggregate, a continuous cutting profile with suitable axial overlaps, radial overlaps, etc.); stabilizer pads (e.g., width, axial position, gauge protection element layout, etc.); reaming portions (e.g., number, position, profile, or type of reaming portions); other characteristics, or combinations of the foregoing.

Figure 4:
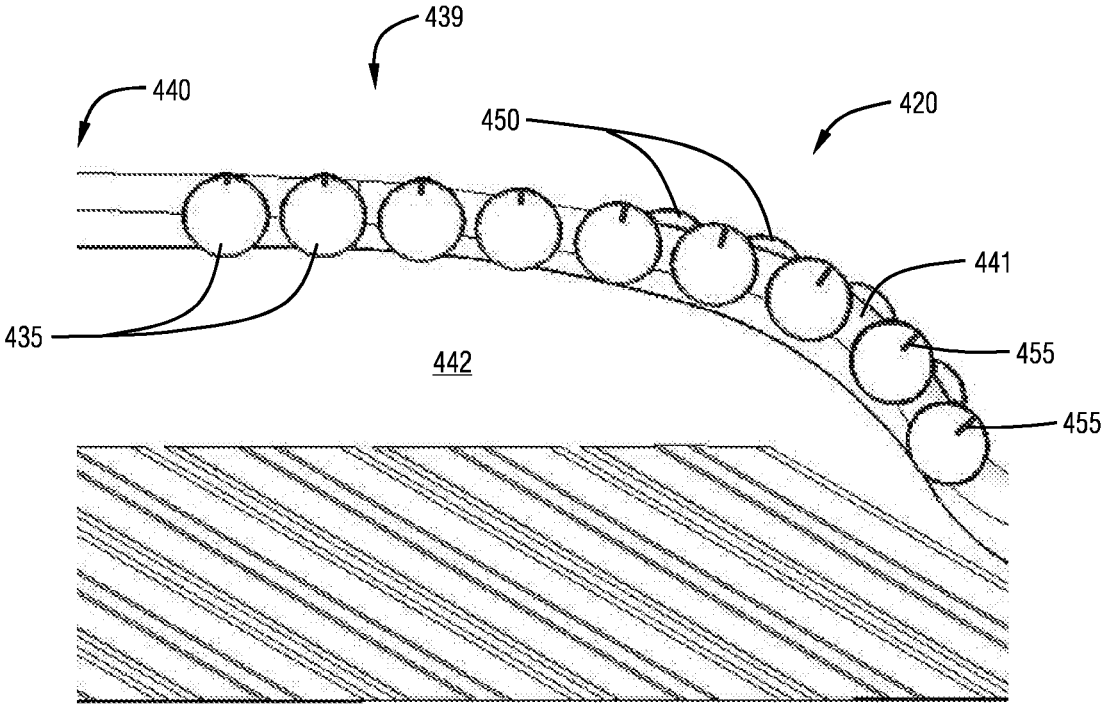
FIG. 4 is a side view of another cutter block, in accordance with embodiments disclosed herein.
Figure 5:
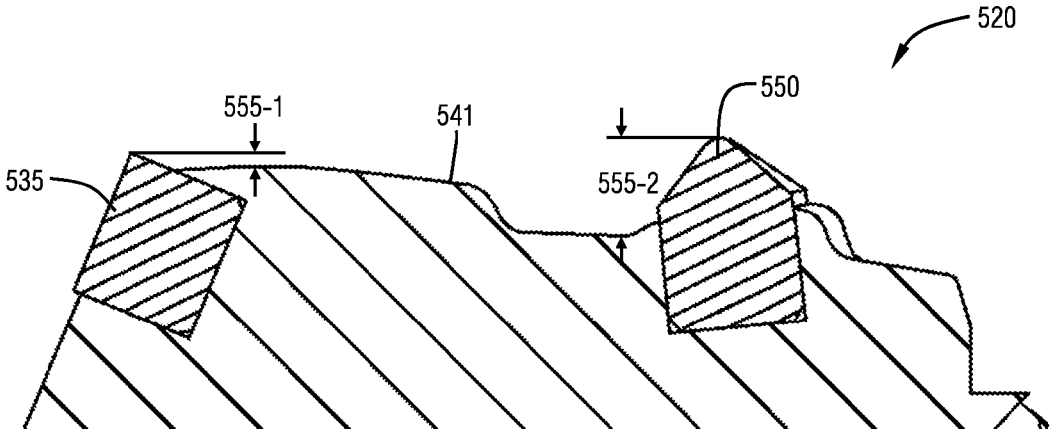
FIG. 5 is a cross-sectional side view of a portion of a cutter block having leading and trailing cutting elements, in accordance with embodiments disclosed herein.

FIGS. 4 and 5 illustrate some example arrangements of cutting elements that are optionally employed in some embodiments of the present disclosure. In FIG. 4, for instance, a cutting tool (shown as a cutter arm or cutter block 420) may include multiple cutting elements 435 arranged in any suitable manner. In this particular embodiment, for instance, leading cutting elements 435 and trailing cutting elements 450 are arranged to extend axially along a length of a portion (e.g., an underreaming or backreaming portion) of the cutter block 420. In at least some embodiments, one or more of the cutting elements 435 may have a non-zero exposure. Exposure refers the distance from the tip of the cutting element 435 and the corresponding surface of the block, and may generally define the depth of cut for a corresponding cutting element 435. Exposure may be similarly defined for a trailing cutting element 450. In some embodiments, the corresponding surface of the cutter block 420 may be a top or formation facing surface 441, although other portions of the cutter block 420 may define the exposure depending on the location of the cutting elements 435, 450. A positive exposure refers to cutting elements 435, 450 above the corresponding cutter block surface and a negative exposure refers to cutting elements 435, 450 recessed within the corresponding cutter block surface.

Each cutting element 435, 450 may have the same exposure, or each cutting element 435, 450 may have no exposure. In other embodiments, the exposure may be varied such that one or more cutting elements 435, 450 have a different exposure from one or more other cutting elements 435, 450. In FIG. 4, for instance, a side view of the cutter block 420 shows leading cutting elements 435 on the leading side surface 442, and trailing cutting elements 450 on the formation facing surface 441. In at least some embodiments, the exposure 455 of one or more of the leading cutting elements 435 is shown by the line extending inwardly from each cutting tip of the cutting elements 435. The exposure 455 may be variable. In the illustrated embodiment, for instance, the exposure 455 of a leading cutting element 435 may be different from the exposure 455 of an adjacent leading cutting element 435 or different from the exposure 455 of each other leading cutting element 435. In some embodiments, each leading cutting element 435 may have a different exposure 455, while in other embodiments, two or more leading cutting elements 435 may have the same exposure 455.

Optionally, the exposure 455 of the leading cutting elements 435 may gradually change. In FIG. 4, for instance, the leading cutting elements 435 are shown as being located on a downhole end portion 439 (e.g., an underreaming portion) that increases in radial height toward an uphole end portion 440 (e.g., a backreaming portion, a stabilizer pad, or a gauge portion). The leading cutting elements 435 nearest the uphole end portion 440 may have a greater radial position and less exposure 455 than leading cutting elements 435 farther from the uphole end portion 440, which may have a lesser radial position. For instance, the exposure 455 of the leading cutting element 435 nearest the uphole end portion 440 may be less than the exposure 455 of any other leading cutting element 435, the exposure 455 of the leading cutting element 435 farthest from the uphole end portion 440 may be greater than the exposure 455 of any other leading cutting element 435, or combinations of the foregoing may apply.

Optionally, the exposure 455 may gradually increase when moving axially away from the uphole end portion 440. In such an embodiment, the exposure 455 of a leading cutting element 435 may be greater than the exposure 455 of an adjacent leading cutting element 435 that is axially nearer the uphole end portion 440. In other embodiments, the exposure 455 may gradually or otherwise decrease when moving axially away from the uphole end portion 440. In still other embodiments, adjacent leading cutting elements 435 may have the same exposure. Optionally, the leading cutting elements 435 with a higher depth of cut (and higher volume of material removed) may have higher exposure 455, and leading cutting elements 435 with lower depth of cut and lower removal volume may have a lower depth of cut. For instance, leading cutting elements 435 nearer the uphole end portion 440 and at a greater radial position may have a lower depth of cut and a lower removal volume, while leading cutting elements 435 farther from the uphole end portion 440 and at a lesser radial position may have a greater depth of cut and a greater removal volume. In at least some embodiments, leading cutting elements 435 near the uphole end portion 440 or at greater radial positions may be protected against increased impact damage from high lateral vibrations by reducing the exposure 455 of such leading cutting elements 435. Reduced exposure 455 at greater radial positions, gradual changes to exposure 455, or combinations thereof, may allow vibrations to be distributed across the body of the cutter block 420. In some embodiments, a variable exposure may further reduce stick-slip tendencies, whirl tendencies, or both, that could result from a side cutting element taking a sudden high depth of cut due to lateral vibrations, which could result in an eccentric pivot point.

In some embodiments, the cutting elements 435, 450 of the cutter block 420 may have multiple exposure gradients or variations. For instance, the cutter block 420 may have multiple tiers or stages of reaming portions (e.g., reaming portions 347-1, 347-2, 347-3 and uphole end portion 340). One or more of these reaming portions may have a gradient. For instance, uphole end portion 340 may have an exposure gradient, the second reaming portion 347-2 may start or have a different exposure gradient, the third reaming portion 347-2 may have another exposure gradient, the first reaming portion 347-1 may also have another exposure gradient when including multiple cutting elements 325 or cutting elements 350, or a combination of the foregoing. Each exposure gradient may gradually change from left-to-right or right-to-left in the view shown in FIG. 3-2. Each exposure gradient may change in the same direction or one or more of the gradients may be in a different direction. For instance, the reaming portion in the uphole end portion 340 may increase exposure from right-to-left while an exposure gradient in the reaming portions 347-1, 347-2, 347-3 may increase from left-to-right.

The amount each leading cutting element 435 is exposed may be different in various embodiments, and may be based on a number of factors, including the type or shape of the leading cutting elements 435, the type and shape of the cutter block 420, the type of formation or other material to be cut by the cutter block 420, the amount of vibration anticipated in a downhole operation, the rate of penetration that is desired, other factors, or combinations of the foregoing. For instance, in some embodiments, the exposure 455 of each leading cutting element 435 (and potentially between different leading cutting elements 435 in embodiments with a variable exposure 455) may be within a range having lower limits, upper limits, or both lower and upper limits including any of 0.000 in. (0.0 mm), 0.005 in. (0.1 mm), 0.01 in. (0.3 mm), 0.025 in. (0.6 mm), 0.05 in. (1.3 mm), 0.075 in. (1.9 mm), 0.1 in. (2.5 mm), 0.125 in. (3.2 mm), 0.15 in. (3.8 mm), 0.175 in. (4.4 mm), 0.2 in. (5.1 mm), 0.225 in. (5.7 mm), 0.25 in. (6.4 mm), 0.275 in. (7.0 mm), 0.3 in. (7.6 mm), 0.4 in. (10.2 mm), 0.5 in. (12.7 mm), or values therebetween. For instance, the exposure 455 of the leading cutting elements 435 of the downhole end portion 439 may be between 0.000 in. (0.0 mm) and 0.4 in. (10.2 mm), between 0.005 in. (0.1 mm) and 0.25 in. (6.4 mm), or between 0.005 in. (0.1 mm) and 0.2 in. (5.1 mm). In other embodiments, the exposure 455 may be negative or may be greater than 0.5 in. (12.7 mm).

Varying the exposure 455 of leading cutting elements 435 may be used where the downhole end portion 439 is an underreaming portion or a backreaming portion. A variable exposure 455 may therefore be present on an underreaming portion, on a backreaming portion, or on both an underreaming portion and a backreaming portion. Additionally, the trailing cutting elements 450 may have a constant exposure 455 or a variable exposure 455. For instance, trailing cutting elements 450 may have the same gradient or changes in exposure 455 as leading cutting elements 435. In some embodiments, the trailing cutting elements 450 are in a back-up position directly behind a leading cutting element 435, or in another trailing position (e.g., when axially offset from leading cutting elements 435, on a second blade on the cutter block 420, etc.).

FIG. 5 is a cross-sectional view of a portion of an example cutter block 520 that has a leading cutting element 535 and a trailing cutting element 550. As shown, the leading cutting element 535 may be a shear cutting element having a planar face, while the trailing cutting element 550 may be a conical or other non-planar cutting element. In other embodiments, both the leading and trailing cutting elements 535 may be shear or planar cutting elements, or both may be conical or non-planar cutting elements.

The trailing cutting element 550 may have the same exposure as the corresponding leading cutting element 535. In other embodiments, however, the leading and trailing cutting elements 535 may have different exposures relative to a formation facing surface 541. For instance, in FIG. 5, the trailing cutting element 550 is shown as having an exposure 555-2 that is greater than the exposure 555-1 of the leading cutting element 535. In other embodiments, the exposure 555-1 may be greater than the exposure 555-2. In some embodiments, the leading cutting element 535, the trailing cutting element 550, or both may have a negative exposure or no exposure relative to an adjacent portion of the formation facing surface 541.

The cutter block 520 may have multiple leading cutting elements 535, multiple trailing cutting elements 550, or combinations of the foregoing. The leading cutting elements 535, trailing cutting elements 550, or both, may have a variable exposure as described herein. In some embodiments, for instance, the leading cutting elements 535 and the trailing cutting elements 550 may have a variable exposure. In other embodiments, the leading cutting elements 535 may have a variable exposure while the trailing cutting elements 550 each have the same exposure (i.e., a fixed or constant exposure). In still other embodiments, each of the leading cutting elements 535 may have the same, fixed or constant exposure while the trailing cutting elements 550 have a variable exposure. In still other embodiments, one or more leading cutting elements 535 may have a different exposure than other leading cutting elements 535 having the same exposure as each other. Similarly, one or more trailing cutting elements 550 may have a different exposure than other trailing cutting elements 550 having the same exposure as each other.

The term "cutting element" as used herein generically refers to any type of cutting element, unless otherwise specified. Cutting elements may have a variety of configurations, and in some embodiments may have a planar cutting face (e.g., similar to cutting elements 535 of FIG. 5). "Non-planar cutting elements" will refer to cutting elements having a non-planar cutting surface or end, such as a generally pointed cutting end ("pointed cutting element") or a generally conical cutting element having a crest or ridge cutting region ("ridge cutting element"), e.g., having a cutting end terminating in an apex, which may include cutting elements having a conical cutting end (shown by cutting element 550 of FIG. 5 or cutting element 635 of FIG. 6), a bullet cutting element (shown in FIG. 7), or a generally conical cutting element having a ridge (e.g., a crest or apex) extending across a full or partial diameter of the cutting element (shown in FIG. 9-1), for example.

Figure 6:
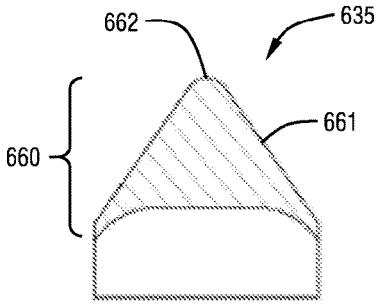
FIGS. 6 to 8 are side cross-sectional views of cutting elements, in accordance with embodiments disclosed herein.
Figure 7:
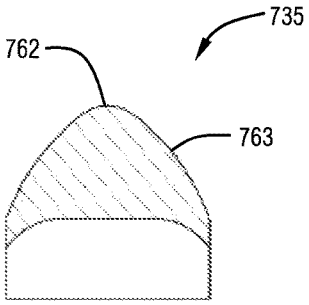
Figure 8:
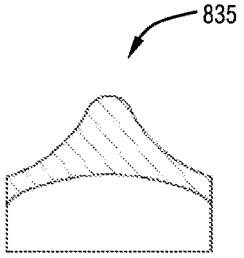

As used herein, the term "conical cutting elements" refers to cutting elements having a generally conical cutting end 660 (including either right cones or oblique cones), i.e., a conical side wall 661 that terminates in a rounded apex 662, as shown in the cutting element 635 of FIG. 6. Unlike geometric cones that terminate at a sharp point apex, the conical cutting elements of some embodiments of the present disclosure possess an apex 662 having curvature between the conical side wall 661 and the apex 662. Further, in one or more embodiments, a bullet cutting element 735 may be used. The term "bullet cutting element" refers to a cutting element having, instead of a generally conical side surface, a generally convex side surface 763 terminating at a rounded apex 762. In one or more embodiments, the apex 762 has a substantially smaller radius of curvature than the convex side surface 763. Both conical cutting elements and bullet cutting elements are "pointed cutting elements," having a pointed end that may be abrupt/sharp or rounded. It is also intended that the non-planar cutting elements of the present disclosure may also include other shapes, including, for example, a pointed cutting element may have a concave side surface terminating in a rounded or apex, as shown by the cutting element 835 of FIG. 8.

Figures 1, 9:
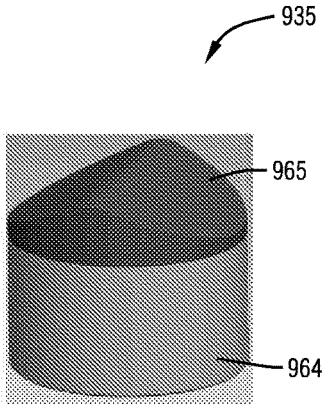
Figures 2, 9:
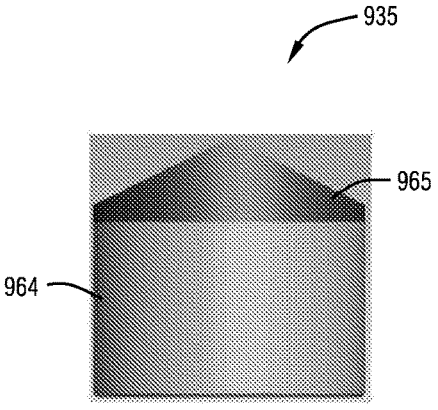
Figure 10:
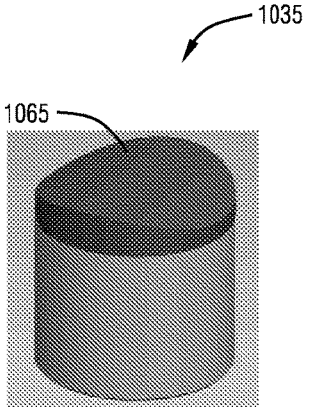
FIG. 10 is a perspective view of another ridge cutting element, in accordance with embodiments disclosed herein.

The term "ridge cutting element" refers to a cutting element that has a cutting crest (e.g., a ridge or apex) extending a height above a substrate (e.g., cylindrical substrate 964 of FIG. 9-1), and at least one recessed region extending laterally away from the crest. An embodiment of a ridge cutting element 935 is depicted in FIGS. 9-1 and 9-2, where the cutting element top surface 965 has a parabolic cylinder shape and is coupled to the substrate 964. Variations of the ridge cutting element may also be used, and for example, while the recessed region(s) may be shown as being substantially planar, the recessed region(s) may instead be convex or concave. While the crest is shown as extending substantially linearly along its length, it may also be convex or concave and may include one or more peaks and/or valleys, including one or more recessed or convex regions (e.g., depressions in the ridge), or may have a crest extending along less than a full width of the cutting element. In some embodiments, the ridge cutting element may have a top surface that has a reduced height between two cutting edge portions, thereby forming a substantially saddle shape or hyperbolic paraboloid (e.g., top surface 1065 of the cutting element 1035 of FIG. 10).

Figures 1, 11:
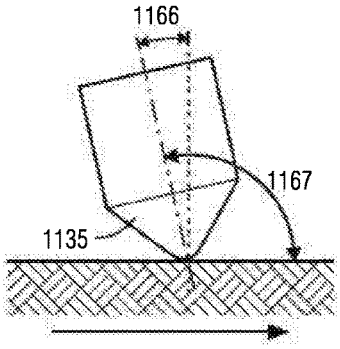
Figures 2, 11:
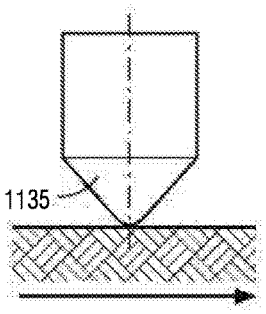
Figures 3, 11:
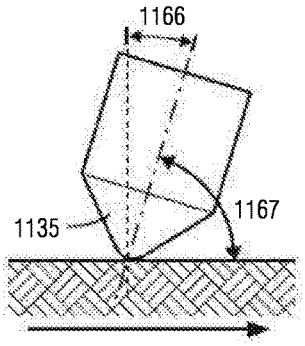

Orientations of planar cutting elements (or shear cutting elements) on an underreamer may be referenced using terms such as "side rake" and "back rake." While non-planar cutting elements may be described as having a back rake and side rake in a similar manner as planar cutting elements, non-planar cutting elements may not have a cutting face or may be oriented differently (e.g., out from a formation facing surface rather than toward a leading edge), and thus the orientation of non-planar cutting elements should be defined differently. When considering the orientation of non-planar cutting elements, in addition to the vertical or lateral orientation of the cutting element body, the non-planar geometry of the cutting end also affects how and the angle at which the non-planar cutting element strikes the formation. Specifically, in addition to the back rake affecting the aggressiveness of the interaction of the non-planar cutting element with the formation, the cutting end geometry (specifically, the apex angle and radius of curvature) may greatly affect the aggressiveness that a non-planar cutting element attacks the formation. In the context of a pointed cutting element, as shown in FIGS. 11-1 to 11-3 (collectively FIG. 11), back rake is defined as the angle 1166 formed between the axis of the pointed cutting element 1135 (specifically, the axis of the pointed cutting end) and a line that is normal to the formation or other material being cut. As shown in FIG. 11-2, with a pointed cutting element 1135 having zero back rake, the axis of the pointed cutting element 1135 is substantially perpendicular or normal to the formation material. As shown in FIG. 11-3, a pointed cutting element 1135 having negative back rake angle 1166 has an axis that engages the formation material at an angle 1167 that is less than 90° as measured from the formation material. Similarly, a pointed cutting element 1135 having a positive back rake angle 1166 as shown in FIG. 11-1 has an axis that engages the formation material at an angle 1167 that is greater than 90° when measured from the formation material. In some embodiments, the back rake angle 1166 of the pointed cutting elements may be zero, or in some embodiments may be negative. In some embodiments, the back rake angle of the pointed cutting elements 1135 may be between −20° and 20°, −10° and 10°, 0° and 10°, or −5° and 5°.

Figure 12:
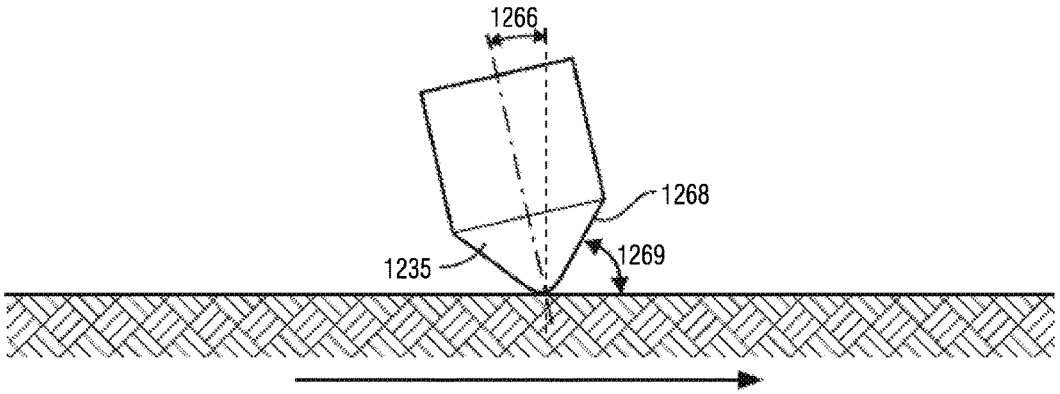
FIG. 12 is a side view of a cutting element having a strike angle, in accordance with embodiments disclosed herein.

In addition to the orientation of the axis with respect to the formation, the aggressiveness of pointed or other non-planar cutting elements may also be dependent on the apex angle or specifically, the angle between the formation and the leading portion of the non-planar cutting element. Because of the cutting end shape of the non-planar cutting elements, there does not exist a leading edge as found in a planar/shear cutting element; however, the leading line of a non-planar cutting surface may be determined to be the first points of the non-planar cutting element at each axial point along the non-planar cutting end surface as the attached body (e.g., body of an underreamer cutter block) rotates around a tool axis. Said in another way, a cross-section may be taken of a non-planar cutting element along a plane in the direction of the rotation of the tool, as shown in FIG. 12. The leading line 1268 of the pointed cutting element 1235 in such plane may be considered in relation to the formation. The strike angle of a pointed cutting element 1235 is defined to be the angle 1269 formed between the leading line 1268 of the pointed cutting element 1235 and the formation (or other workpiece) being cut. The angle 1269 may be affected by the geometry of the cutting element 1235, the back rake angle 1266, or other factors.

For polycrystalline diamond compact cutting elements (e.g., shear cutters), side rake is conventionally defined as the angle between the cutting face and the radial plane of the downhole tool (x-z plane). Non-planar cutting elements do not have a planar cutting face and thus the orientation of pointed cutting elements should be defined differently. In the context of a non-planar cutting element such as the pointed cutting elements 1335, shown in FIGS. 13-1 to 14-3, side rake is defined as the angle 1370 formed between the axis of the cutting element 1335 (specifically, the axis of the conical cutting end in the illustrated embodiment) and a line perpendicular to the tool or cutter block centerline. Side rake may be defined in other manners. For instance, side rake could be defined as an angle formed between the axis of the cutting element 1335 and a line perpendicular to the tangent of the profile of the cutter block at the location of the cutting element. In FIGS. 13-1 to 14-3, the z-axis may represent the line perpendicular to the tool centerline or the line perpendicular to the tangent of the cutter block profile.

Figures 1, 13:
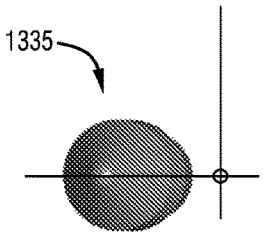
Figures 2, 13:
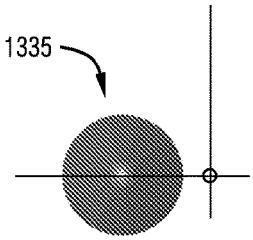
Figures 3, 13:
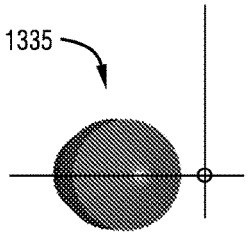
Figures 1, 14:
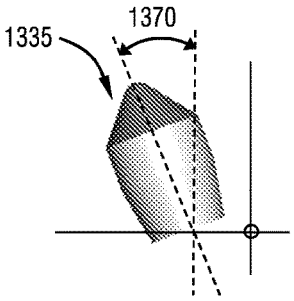
Figures 2, 14:
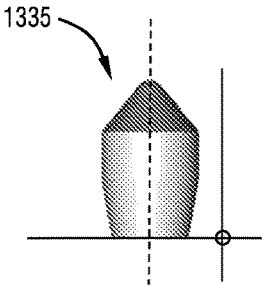
Figures 3, 14:
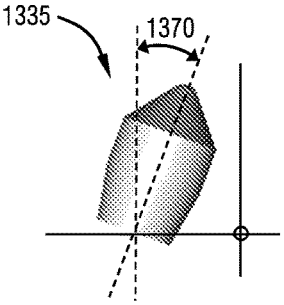

As shown in FIGS. 13-2 and 14-2, with a pointed cutting element 1335 having zero side rake, the axis of the pointed cutting element 1335 is substantially parallel to the z-axis. A pointed cutting element 1335 having negative side rake angle 1370, as shown in FIGS. 13-1 and 14-1 has an axis that is pointed away from the direction of the tool centerline. Conversely, a pointed cutting element 1335 having a positive side rake angle 1370 as shown in FIGS. 13-3 and 14-3 has an axis that points toward the direction of the tool centerline. The side rake of the pointed cutting elements 1335 may range between −30° and 30°, between −10° and 10°, or between −5° and 5° in some embodiments. Further, the side rake angle 1370 of non-planar cutting elements may be selected from these or other ranges in embodiments of the present disclosure. In some embodiments, leading cutting elements and trailing cutting elements may have the same or different side rake angles and/or back rake angles. For instance, a leading cutting element may have a positive back rake angle between 15° and 20° while a trailing or back-up cutting element may have a positive back rake angle of between 7° and 15°. In some embodiments, the side rake angle 1370 relative to the profile of a cutter block may be between −5° and 5°.

It should be understood that while elements are described herein in relation to depicted embodiments, each element may be combined with other elements of other embodiments. For example, any or each of the planar cutting elements 335 of FIGS. 3-1 to 3-3 may be replaced by non-planar cutting elements, or any or each of the conical cutting elements 350 of FIGS. 3-1 to 3-3 may be replaced by planar cutting elements or other non-planar cutting elements.

While embodiments of underreamers and cutter blocks have been primarily described with reference to wellbore enlargement operations, the devices described herein may be used in applications other than the drilling or enlargement of a wellbore. In other embodiments, underreamers and cutter blocks according to the present disclosure may be used outside a wellbore or other downhole environment used for the exploration or production of natural resources. For instance, tools and assemblies of the present disclosure may be used in a wellbore used for placement of utility lines, in a medical procedure (e.g., to clear blockages within an artery), in a manufacturing industry (e.g., to expand a diameter of a bore within a component), or in other industries (e.g., aquatic, automotive, etc.). Accordingly, the terms "wellbore," "borehole" and the like should not be interpreted to limit tools, systems, assemblies, or methods of the present disclosure to any particular industry, field, or environment.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value. Where a range of values includes various lower or upper limits, any two values may define the bounds of the range, or any single value may define an upper limit (e.g., up to 50%) or a lower limit (at least 50%).

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements. It should be understood that "proximal," "distal," "uphole," and "downhole" are relative directions. As used herein, "proximal" and "uphole" should be understood to refer to a direction toward the surface, rig, operator, or the like. "Distal" or "downhole" should be understood to refer to a direction away from the surface, rig, operator, or the like. When the word "may" is used herein, such term should be interpreted as meaning that the identified feature, function, characteristic, or the like is present in some embodiments, but is not present in other embodiments. Numerical terms such as "first," "second," "third," "fourth," and the like when used to identify certain components or features are used to distinguish similar components (or similarly referenced components) and are not used to limit any component to a specific embodiment or numerical reference. For instance, a component referred to as a "first" component in the claims may refer to or include a "first," "second," "third," "fourth," or other component from the specification, based on the context in the claim.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A cutting apparatus, comprising:

a cutter arm including a longitudinal axis, the cutter arm having at least:

a first stabilizer portion adjacent a first reaming portion of the cutter arm;

a second stabilizer portion between the first reaming portion and a second reaming portion of the cutter arm; and a gauge portion adjacent the second reaming portion, the gauge portion including no stabilizer portion or a stabilizer portion having a length less than at least one of the first stabilizer portion or the second stabilizer portion, wherein the gauge portion extends radially further from the longitudinal axis than the first stabilizer portion and the second stabilizer portion; and a plurality of cutting elements in the first and second reaming portions of the cutter arm.

2. The cutting apparatus of claim 1, the stabilizer portion of the gauge portion having a length less than a length of each of the first and second stabilizer portions.

3. The cutting apparatus of claim 1, the plurality of cutting elements including leading planar cutting elements.

4. The cutting apparatus of claim 1, the plurality of cutting elements including trailing non-planar cutting elements.

5. The cutting apparatus of claim 1, the plurality of cutting elements including a plurality of leading cutting elements and a plurality of trailing cutting elements.

6. The cutting apparatus of claim 5, the plurality of leading cutting elements, the plurality of trailing cutting elements, or both, extending in at least one row that is about parallel to the longitudinal axis of the cutter arm.

7. The cutting apparatus of claim 5, the plurality of leading cutting elements, the plurality of trailing cutting elements, or both, extending in a row that is at an angle between 25° and 65° relative to the longitudinal axis of the cutter arm.

8. The cutting apparatus of claim 1, further comprising at least one of:

a third reaming portion, the second stabilizer portion being between the second and third reaming portions of the cutter arm; or a fourth reaming portion, the first stabilizer portion being between the first reaming portion and the fourth reaming portion of the cutter arm.

9. The cutting apparatus of claim 8, the first, second, and fourth reaming portions being underreaming portions and the third reaming portion being a backreaming portion.

10. The cutting apparatus of claim 1, the plurality of cutting elements having an exposure gradient.

11. The cutting apparatus of claim 1, the plurality of cutting elements having at least two exposure gradients.

* * * * *